US009597724B2

(12) United States Patent
Kodi

(10) Patent No.: US 9,597,724 B2
(45) Date of Patent: Mar. 21, 2017

(54) WIRE TWISTING TOOLS AND METHODS

(76) Inventor: Jon R. Kodi, Lebanon, TN (US)

( * ) Notice: Subject to any disclaimer, the term of this patent is extended or adjusted under 35 U.S.C. 154(b) by 1403 days.

(21) Appl. No.: 13/216,980

(22) Filed: Aug. 24, 2011

(65) Prior Publication Data

US 2012/0055578 A1 Mar. 8, 2012

Related U.S. Application Data

(60) Provisional application No. 61/379,642, filed on Sep. 2, 2010.

(51) Int. Cl.
*B21F 15/04* (2006.01)
*B21F 7/00* (2006.01)

(52) U.S. Cl.
CPC ..... *B21F 15/04* (2013.01); *B21F 7/00* (2013.01)

(58) Field of Classification Search
CPC ..... B65B 13/28; B65B 13/285; B21F 15/04; B21F 7/00; B21F 27/06
USPC ..... 140/93.4, 36, 39, 118
See application file for complete search history.

(56) References Cited

U.S. PATENT DOCUMENTS 1,060,185 A * 4/1913 Hitt ..... B25B 13/463 81/185
1,706,116 A 9/1929 Harrah
1,978,164 A 10/1934 Van Inwagen
2,129,063 A 9/1938 Kind
2,779,356 A 1/1957 Schulze
2,796,662 A 6/1957 Saum
3,026,915 A 3/1962 Jones et al.
3,065,773 A 11/1962 De Vries
3,169,559 A 2/1965 Working, Jr.
3,211,187 A 10/1965 Paule et al.
3,492,228 A 1/1970 Kim
3,587,668 A 6/1971 Ward
3,590,391 A 7/1971 Winegar
3,590,885 A 7/1971 Ward
3,650,302 A 3/1972 Palms
3,908,715 A 9/1975 Spiessens
3,985,162 A * 10/1976 Redman ..... B21F 33/04 140/101
4,354,535 A 10/1982 Powell et al.
4,362,192 A 12/1982 Furlong et al.
4,508,030 A 4/1985 Grenon
4,542,773 A 9/1985 LaFon
4,953,598 A 9/1990 McCavey
5,217,049 A 6/1993 Forsyth
(Continued)

FOREIGN PATENT DOCUMENTS

GB 2370330 A * 6/2002 ..... B21F 15/04
WO WO 02/32600 A1 4/2002

*Primary Examiner* — David Bryant
*Assistant Examiner* — Lawrence Averick
(74) *Attorney, Agent, or Firm* — Lucian Wayne Beavers; William E. Sekyi; Patterson Intellectual Property Law PC

(57) ABSTRACT

A wire twisting tool provides a rotatable jaw housing defining an interior cavity and a housing slot shaped for receiving one or more strands of wire. One or more jaw members are disposed in the interior cavity of the jaw housing. The jaw housing is generally rotatable relative at least one jaw member. At least one jaw member advances inwardly during jaw housing rotation and is operable to engage the wire. One or more jaw members can be rotated simultaneously with the jaw housing for twisting the wire. Methods of twisting wire using a wire twisting tool are also provided.

24 Claims, 16 Drawing Sheets

(56) References Cited

U.S. PATENT DOCUMENTS

| | | | | |
|---|---|---|---|---|
| 5,431,196 | A | 7/1995 | Forrester, Jr. et al. | |
| 5,605,181 | A * | 2/1997 | Vuong | B21F 15/04 140/119 |
| 5,613,530 | A | 3/1997 | Kincel et al. | |
| 5,826,629 | A | 10/1998 | West | |
| 5,842,506 | A | 12/1998 | Peters | |
| 5,983,473 | A | 11/1999 | Yuguchi et al. | |
| 6,009,646 | A | 1/2000 | Johnson | |
| 6,488,055 | B2 | 12/2002 | Chen | |
| 6,668,870 | B2 * | 12/2003 | Rossum | B65B 13/285 140/118 |
| 6,837,156 | B2 | 1/2005 | Corbin et al. | |
| 7,051,650 | B2 | 5/2006 | Kusakari et al. | |
| 7,140,400 | B2 | 11/2006 | Yokochi et al. | |
| 7,143,792 | B2 | 12/2006 | Ishikawa et al. | |
| 7,255,135 | B2 | 8/2007 | Ishikawa et al. | |
| 7,299,829 | B2 | 11/2007 | Kim | |
| 7,353,846 | B2 | 4/2008 | Kusakari et al. | |
| 7,398,800 | B2 | 7/2008 | Kusakari et al. | |
| 2006/0157139 | A1 | 7/2006 | Hoyaukin | |
| 2006/0283516 | A1 | 12/2006 | Nagaoka et al. | |
| 2006/0289846 | A1 * | 12/2006 | Cohen | B21F 15/04 256/47 |
| 2008/0110354 | A1 | 5/2008 | Itagaki et al. | |

* cited by examiner

WIRE TWISTING TOOLS AND METHODS

CROSS-REFERENCES TO RELATED APPLICATIONS

This nonprovisional patent application claims priority to U.S. Provisional Patent Application No. 61/379,642 filed Sep. 2, 2010 and entitled "Wire Twisting Tool and Methods".

BACKGROUND

Technical Field

The present disclosure relates generally to machinery and methods for twisting together wire. More particularly, the present disclosure pertains to devices and methods for engaging and mechanically twisting one or more strands of wire. The present disclosure is particularly applicable for twisting together individual strands of wire mesh.

Description of Related Art

Wire mesh is commonly used to reinforce concrete. The wire mesh is typically formed in a grid pattern having numerous individual longitudinal and lateral transverse wire strands. Each wire strand may be spot welded or mechanically attached to other transverse strands, or each wire strand may be loosely positioned across other transverse strands. Wire mesh is typically provided in individual sheets or in rolls. In practice, one or more sheets of wire mesh are arranged in a preform shape and concrete is subsequently poured over the preform structure. Separate sheets of wire mesh are generally interconnected prior to pouring the concrete for effectively transferring stresses within the concrete structure and to prevent the wire mesh from shifting as the concrete is poured.

Traditional methods of connecting wire mesh include using individual wire ties of the types commonly used for securing rebar or other building materials. Typically, a separate wire tie is used for each individual connection between wire mesh panels. Each wire tie must be manually positioned and twisted to secure the strands of wire mesh. In a large wire mesh preform structure, numerous individual wires must be connected. Large projects can require several thousand individual wire connections to assemble the wire mesh preform structure.

Other conventional methods for joining wire mesh include using a crimping tool to apply a metal C-shaped fastener to individual strands to be joined. The crimping tool applies a mechanical force that deforms the fastener around the strands of wire mesh, thereby creating a connection point. However, such conventional crimping tools require additional fasteners that add expense and time. Additionally, the crimps frequently fail or become deformed during application, rendering them useless and leading to increased waste. These conventional tools and techniques for twisting together individual strands of wire mesh for creating a preform structure in many applications reduce worker efficiency, increase project costs and can contribute to worker injury. It is also noted that similar tools and methods are also used in other applications for joining wire, including the construction of wire fences and in many wire packaging applications where wire strands must be mechanically joined. Similarly, devices and methods are needed for twisting metal wires in electrical applications such as joining wires or preparing a multi-stranded wire end for receiving a grounding lug.

What is needed then are improvements in the devices and methods for twisting wires.

BRIEF SUMMARY

The present disclosure in some embodiments provides an apparatus for twisting wire. The apparatus includes a jaw housing defining a housing slot shaped for receiving the wire. A first jaw member is disposed in the jaw housing, and the jaw housing is moveable relative to the first jaw member. A second jaw member is disposed in the jaw housing. The first and second jaw members are operable to clamp the wire between the first and second jaw members when the jaw housing is rotated.

In some additional embodiments, the present disclosure provides a wire twisting apparatus for twisting strands of wire. The apparatus includes a rotatable jaw housing defining an interior cavity and defining a housing slot shaped for receiving the strands of wire. The jaw housing defines a first cam surface generally facing the interior cavity. A first jaw member is disposed in the interior cavity, and the first jaw member includes a first cam extending outwardly therefrom. The first cam is operable to slidably engage the first cam surface and to advance toward the housing slot when the jaw housing is rotated.

Further embodiments of the present disclosure provide an apparatus for twisting one or more strands of wire. The apparatus includes a jaw housing defining a first axle socket. A first jaw member is disposed in the jaw housing. The first jaw member includes a first jaw axle extending axially from the first jaw member, and the first jaw axle pivotally engages the first axle socket. The first jaw member is pivotable about the first jaw axle inside the jaw housing.

The present disclosure further provides an apparatus for twisting wire. The apparatus includes a rotatable jaw housing and a first jaw member disposed in the jaw housing. The first jaw member is operable to clamp the wire when the rotatable jaw housing is moved relative to the first jaw member.

In additional embodiments, the present disclosure provides an apparatus for twisting wire including a tool body and a jaw housing attached to the tool body. The jaw housing includes a housing slot shaped for receiving the wire, wherein the jaw housing is rotatable relative to the tool body. A jaw member is disposed in the jaw housing. The jaw member is configured to advance toward the wire when the jaw housing is rotated.

Yet another embodiment of the present disclosure provides a method of twisting wire. The method includes the steps of: (a) providing a wire twisting apparatus including a jaw housing and first and second jaw members disposed in the jaw housing, the jaw housing including a housing slot shaped for receiving the wire; (b) positioning the wire in the housing slot between the first and second jaw members; and (c) rotating the jaw housing relative to at least one of the first and second jaw members so that at least one of the first and second jaw members moves toward the other jaw member and engages the wire.

Numerous other objects, features and advantages of the present disclosure will be readily apparent to those skilled in the art upon a reading of the following disclosure when taken in conjunction with the accompanying drawings.

DETAILED DESCRIPTION

Figure 1:
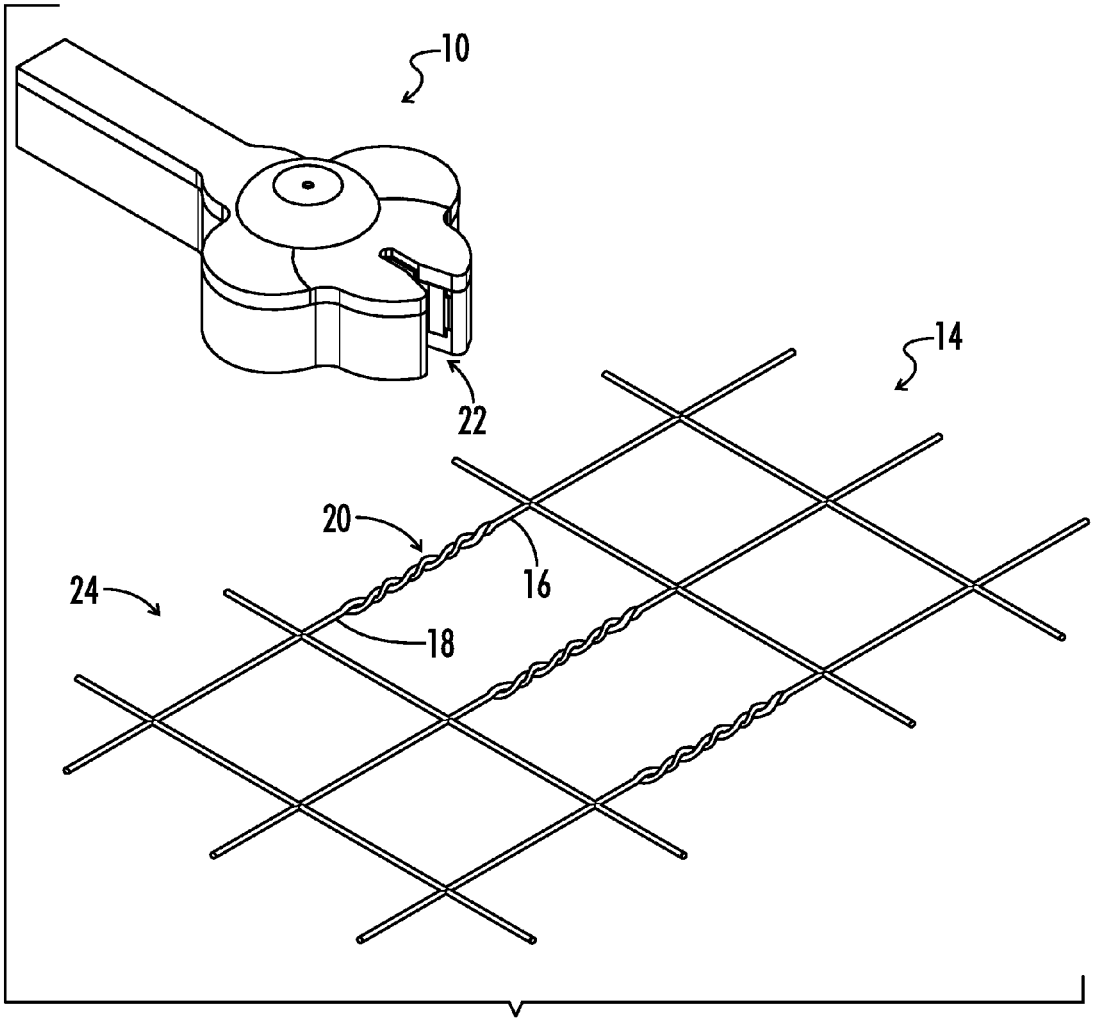
FIG. 1 illustrates a perspective view of one embodiment of a wire twister apparatus in accordance with the present disclosure.

Referring now to the drawings, FIG. 1 illustrates a perspective view of an embodiment of an apparatus for twisting wire, or a wire twister, generally designated by the numeral 10. In the drawings, not all reference numbers are included in each drawing, for the sake of clarity. In addition, positional terms such as "upper," "lower," "side," "top," "bottom," etc. refer to the apparatus when in the orientation shown in the drawing. The skilled artisan will recognize that the apparatus can assume different orientations when in use.

As seen in FIG. 1, wire twister 10 includes a mouth 22 shaped for receiving one or more wire strands 16, 18. First wire strand 16 extends from first wire mesh panel 14, and second wire strand 18 extends from second wire mesh panel 24. Each individual wire strand 16, 18 is generally inserted in mouth 22 prior to twisting, or joining. The wire strands 16, 18 are then twisted together inside wire twister 10 leaving first and second wire strands 16, 18 mechanically joined to form a twisted connection 20. The wire twister 10 is then removed from the twisted connection 20. Various resulting twisted wire profiles may result from the twisting of wires using wire twister 10 in different applications and embodiments.

Figure 2:
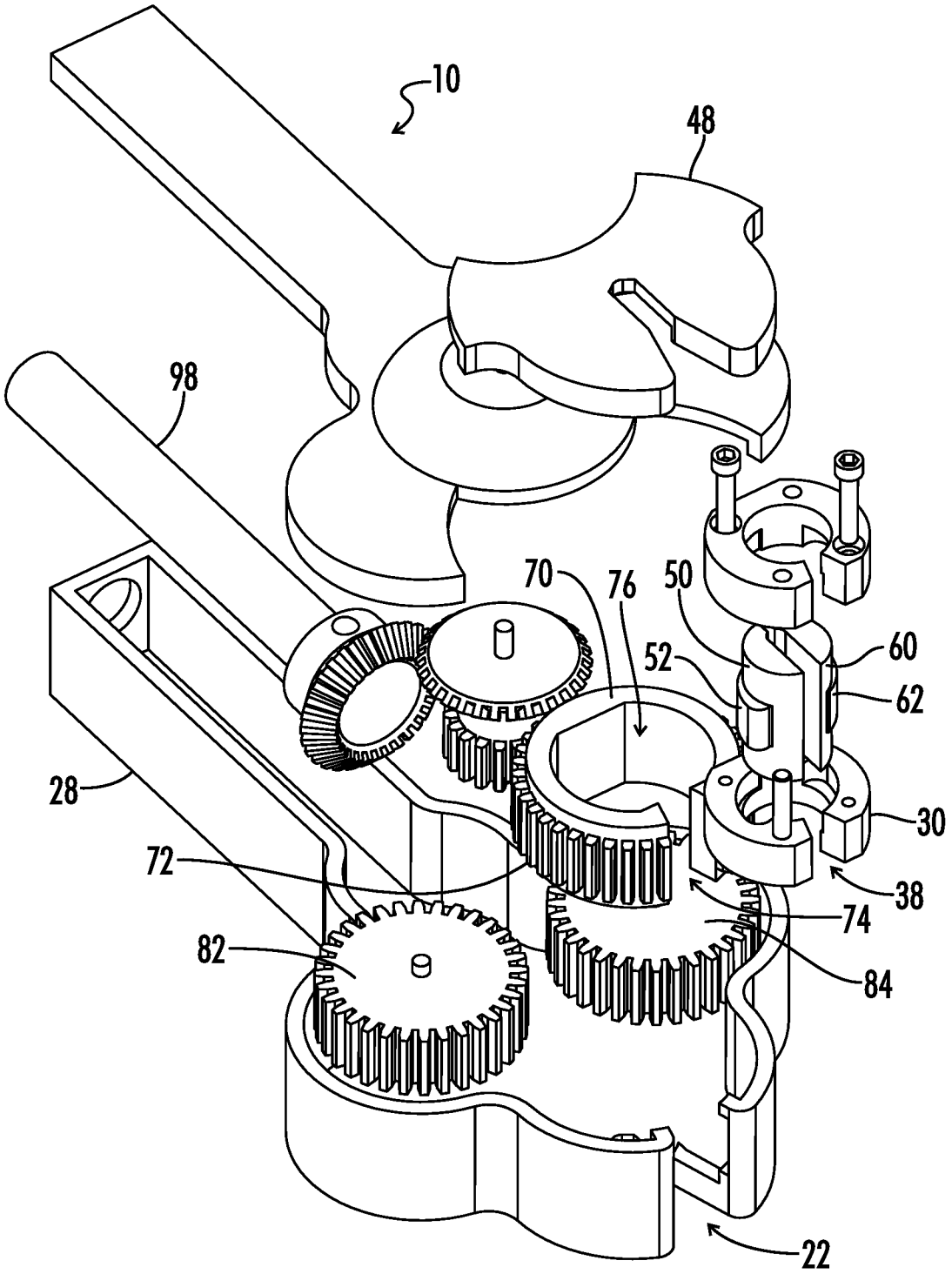
FIG. 2 illustrates a perspective exploded view of one embodiment of a wire twister apparatus in accordance with the present disclosure.

Referring now to FIG. 2, an exploded view of an embodiment of a wire twister 10 is generally illustrated. In this embodiment, wire twister 10 generally includes a jaw housing 30 defining a housing slot 38 shaped for receiving one or more wire strands. Housing slot 38 in some embodiments is a radial housing slot extending generally toward the jaw housing axis of rotation. Jaw housing 30 is generally rotatable relative to mouth 22. Jaw housing 30 can, in some embodiments, form an insert shaped for fitting in a jaw housing sleeve 70. Jaw housing sleeve 70 generally defines a sleeve cavity 76 shaped for receiving jaw housing 30. Sleeve 70 includes a sleeve slot 74 generally aligned with housing slot 38. Sleeve slot 74 is configured for receiving one or more wire strands. A sleeve gear 72 in some embodiments is circumferentially disposed on sleeve 70.

Sleeve gear 72 is engaged by first and second drive gears 82, 84. Drive gears 82, 84 are spaced so that at least one of first and second drive gears 82, 84 maintains engagement with sleeve gear 72 for rotating sleeve gear 72 during wire twisting even as sleeve slot 74 passes by the point of engagement on the other drive gear. In other embodiments, a circumferential housing gear is defined directly on jaw housing 30, and no sleeve 70 is present. In such an alternative embodiment, illustrated for example in FIG. 6, FIG. 10 and FIG. 17, circumferential housing gear 40 engages first and second drive gears 82, 84 at first and second engagement locations 214, 216 respectively. First engagement location 214 is defined as the engagement point between first drive gear 82 and jaw housing 30 along a reference line extending between jaw housing axis of rotation 212 and first drive gear axis of rotation 208. Second engagement location 216 is defined as the engagement point between second drive gear 84 and jaw housing 30 along a reference line extending between jaw housing axis of rotation 212 and second drive gear axis of rotation 210. In this embodiment, housing slot 38 includes a housing slot opening angle 204 defined as the angular distance between gear teeth on opposite sides of housing slot 38. Also, first and second drive gears are separated by a drive gear offset angle 206 defined as the angular distance between first and second engagement locations 214, 216. In one embodiment, drive gear offset angle 206 is greater than housing slot opening angle 204 so that when housing slot 38 passes over one of the drive gears, the other drive gear maintains engagement with circumferential housing gear 40. In this embodiment, at least one drive gear tooth of the first and second drive gears 82, 84 will be engaged with at least one gear tooth on the housing gear 40 even as housing slot 38 passes by the other drive gear. It is understood that, in other embodiments, first and second drive gears and jaw housing can have larger or smaller radii and different gear configurations as compared to the embodiment illustrated in FIG. 17. It is further understood that first and second drive gears are actuated in some embodiments, by a rotary shaft 98, seen in FIG. 2. Rotary shaft 98 can extend from, or can be coupled to, a conventional rotary tool, such as a powered drill or a manual crankshaft in some embodiments and may be coupled to first and/or second drive gears using a bevel gear.

Referring again to FIG. 2, jaw housing 30 and drive gears 82, 84 are housed in a, tool body, or gear housing 28. In one embodiment, a removable jaw housing cover plate 48 is positioned over jaw housing 30 on gear housing 28 to allow access to jaw housing 30 without exposing other components housed within gear housing 28. It will be readily appreciated by those of skill in the art that, in other embodiments, jaw housing 30 can be exposed or covered by gear housing 28, and no cover plate 48 may be necessary for containing jaw housing 30 in gear housing 28.

Figure 3A:
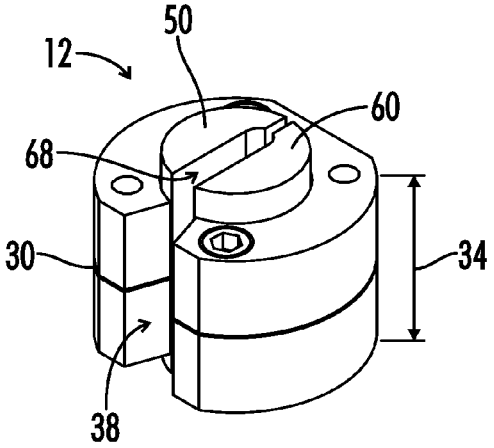
FIG. 3A illustrates a perspective view of a first embodiment of a jaw assembly in accordance with the present disclosure.
Figure 3B:
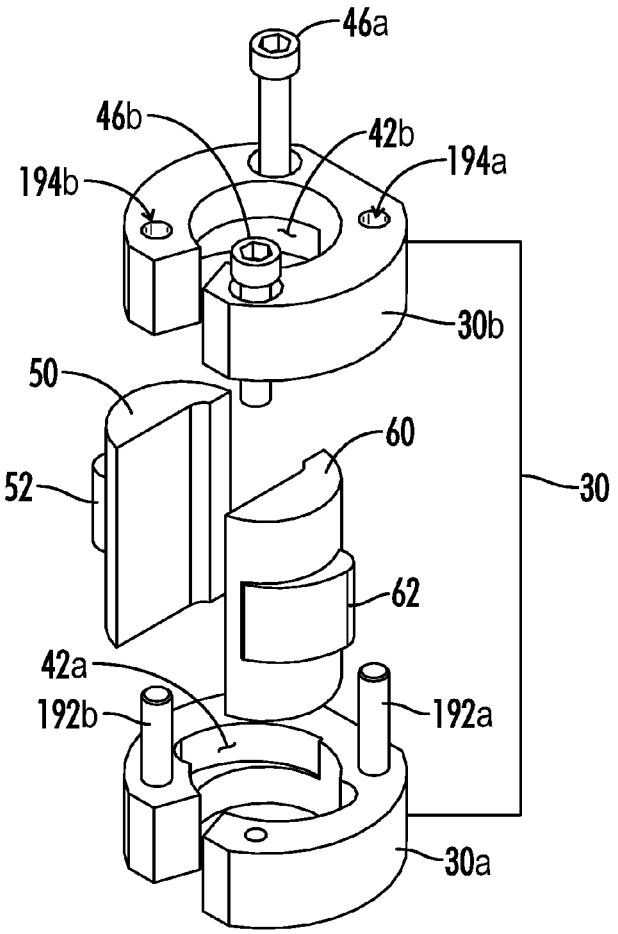
FIG. 3B illustrates a perspective exploded view of the jaw assembly of FIG. 3A.
Figure 18:
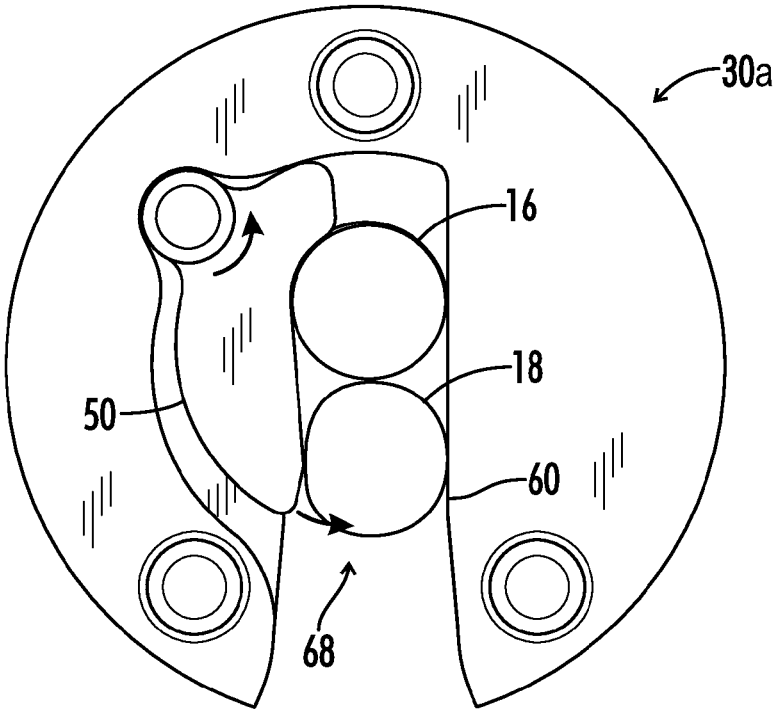
FIG. 18 illustrates a plan view of an embodiment of a jaw assembly having an integrally formed jaw member and only one pivotable jaw member.
Figure 19:
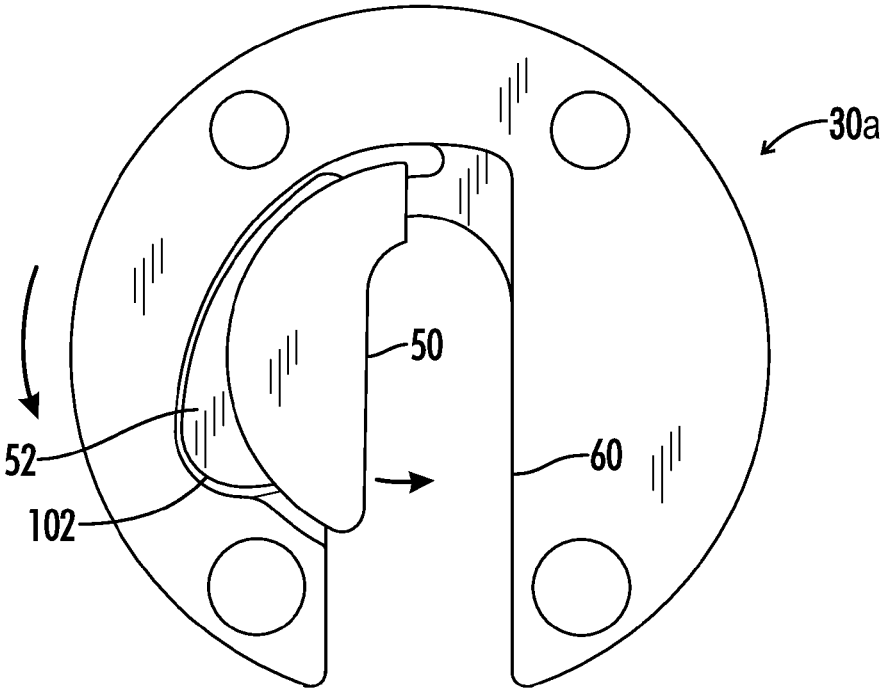
FIG. 19 illustrates a plan view of an embodiment of a jaw assembly having an integrally formed jaw member and only one pivotable jaw member.

Referring further to FIGS. 2, 3A and 3B, in some embodiments, first and second jaw members 50, 60 are disposed in jaw housing 30, forming a jaw assembly 12, seen in FIG. 3A. Jaw assembly 12 includes a first jaw member 50 and a second jaw member 60 disposed in jaw housing 30. Jaw housing 30 defines a housing slot 38 shaped for receiving wire. First and second jaw members 50, 60 are generally disposed in jaw housing 30 such that jaw housing 30 is rotatable about at least one of first and second jaw members 50, 60. In some other embodiments, jaw housing 30 is partially rotatable about both first and second jaw members 50, 60. As seen in FIG. 3A, first and second jaw members 50, 60 define a jaw gap 68 therebetween. Jaw gap 68 is generally angularly aligned with housing slot 38 prior to insertion of one or more wire strands into housing slot 38. Generally, during use, one or more wire strands are inserted through housing slot 38 into jaw gap 68. As seen in FIG. 3A, in some embodiments, housing slot 38 is beveled to create a tapered opening to better facilitate wire insertion. Jaw housing 30 can be rotated relative to at least one of first and second jaw members 50, 60. In some embodiments, the presence of one or more wire strands in jaw gap 68 tends to cause first and second jaw members 50, 60 to remain at an initial angular alignment even when jaw housing 30 is rotated. As jaw housing 30 is rotated, jaw gap 68 can become angularly offset relative to housing slot 38. As jaw housing 30 is rotated further, first and second jaw members 50, 60 can begin to rotate simultaneously with jaw housing 30, causing the one or more wire strands to be clamped between first and second jaw members 50, 60 and twisted. It will be appreciated by those of skill in the art that, in some embodiments, one of first and second jaw members 50, 60 can be integrally formed on jaw housing 30, or rigidly fixed relative to jaw housing 30, without adversely affecting the ability of jaw assembly 12 to perform the desired wire twisting function. For example, as illustrated in FIG. 18, second jaw member 60 is integrally formed on jaw housing 30. Similarly, in another embodiment illustrated in FIG. 19, second jaw member 60 is integrally formed on jaw housing 30. In these embodiments, first jaw member is operative to clamp one or more wires between first and second jaw members 50, 60 when jaw housing 30 is rotated. In some embodiments, only one jaw member is rotatably disposed in the jaw housing.

Referring now to FIG. 3B, in some embodiments, jaw housing 30 further includes a first jaw housing member 30*a* and a second jaw housing member 30*b*. First and second jaw members 50, 60 are positioned between first and second jaw housing members 30*a* and 30*b*. Second jaw housing member 30*b* can be detachably fastened to first jaw housing member 30*a* using one or more jaw housing fasteners 46*a*, 46*b*, including any type of mechanical fastener, for example a socket head cap screw. In some embodiments, one or more pilot rods 192*a*, 192*b* extend vertically upward from first jaw housing member 30*a* toward second jaw housing member 30*b*. Each pilot rod 192*a*, 192*b* engages a pilot rod clearance hole 194*a*, 194*b*, respectively, defined in second jaw housing member 30*b* for providing proper angular alignment of second jaw housing member 30*b* when positioned on first jaw housing member 30*a* from above.

The first and second jaw members 50, 60 in some embodiments are advanced inwardly during jaw housing rotation by one or more cams positioned on first and second jaw members 50, 60. Referring now to one embodiment seen in FIG. 3B, a first cam 52 is positioned on first jaw member 50, and a second cam 62 is positioned on second jaw member 60. Each cam generally extends outward from each respective jaw member 50, 60. In some embodiments, first and second cams extend generally radially outwardly. As used herein, the term "radially" generally refers to a direction away from or toward the vicinity of the jaw housing axis of rotation. It is understood that the term radially as used herein refers not only to a direction along a linear radius of a circle, but also in a direction generally toward or away from a center, or axis, of the circle. For example, when the first and/or second jaw member moves "radially" inward, the jaw member does not move exactly along a linear radius of the jaw housing, but rather moves generally closer to the axis of rotation of the jaw housing.

In some embodiments, seen for example in FIG. 3B, first cam 52 engages a first cam surface on jaw housing 30 when jaw housing 30 is rotated relative to first jaw member 50. First cam surface in some embodiments is defined on both first and second jaw housing members 30*a* and 30*b* as lower first cam surface 42*a* defined on first jaw housing member 30*a* and upper first cam surface 42*b* defined on second jaw housing member 30*b*, as illustrated in FIG. 3B. Similarly, second cam 62 engages a second cam surface defined on jaw housing 30. Second cam surface in some embodiments, includes a lower second cam surface 44*a* defined on first jaw housing member 30*a*, seen in FIG. 5B and an upper second cam surface on second jaw housing member 30*b*, not shown.

Figure 4A:
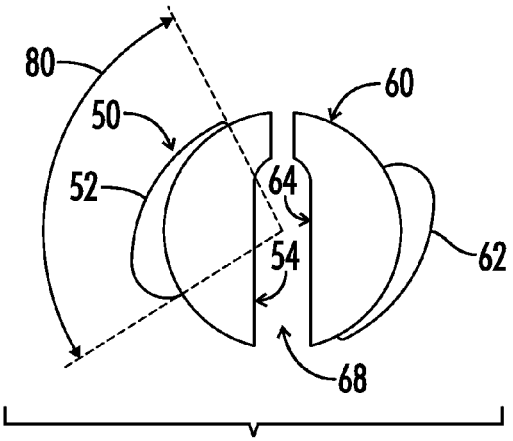
FIG. 4A illustrates a plan view of the embodiment of first and second jaw members of FIG. 3B.
Figure 4B:
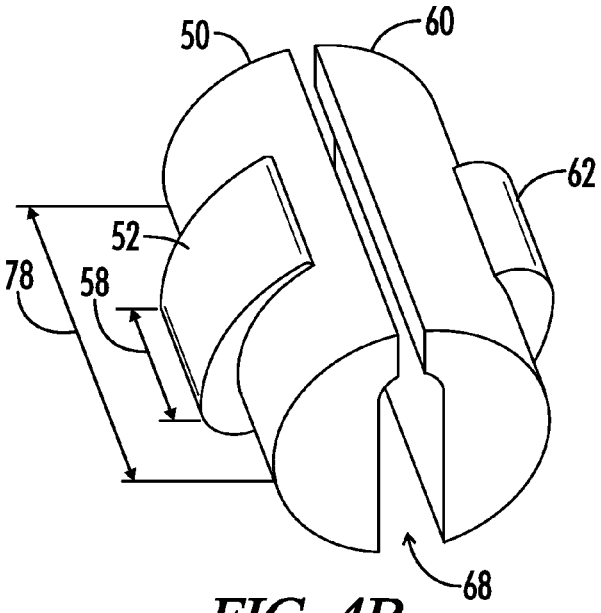
FIG. 4B illustrates a perspective view of the embodiment of first and second jaw members of FIG. 4A.

Referring now to FIGS. 4A and 4B, first and second jaw members 50, 60 define a jaw gap 68 generally adapted for receiving one or more strands of wire. First jaw member 50 defines a first wire engagement surface 54 substantially facing jaw gap 68, and second jaw member 60 defines a second wire engagement surface 64 also facing jaw gap 68. As first cam 52 engages first cam surface 42 during jaw housing rotation, first jaw member 50 advances inwardly toward jaw gap 68. Similarly, in some embodiments, second cam 62 engages second cam surface during jaw housing rotation causing second jaw member 60 to advance inwardly toward jaw gap 68. As first and second jaw members 50, 60 move inwardly, any wire strands positioned in jaw gap 68 are clamped between first and second wire engagement surfaces 54, 64 of first and second jaw members 50, 60, respectively. During use, jaw housing 30 is rotated relative to at least one jaw member. After jaw housing 30 is rotated a threshold angular distance, first and second jaw members engage the wire or wires positioned in jaw gap 68, causing first and second jaw members to subsequently rotate simultaneously with jaw housing 30, providing a mechanical twisting of the wire strands. It is understood that such twisting can be used to mechanically join two or more wires together by twisting the wires around each other. It is further appreciated that, in some embodiments, a single wire can be twisted using jaw assembly 12 for shearing or reshaping the wire.

Figure 5A:
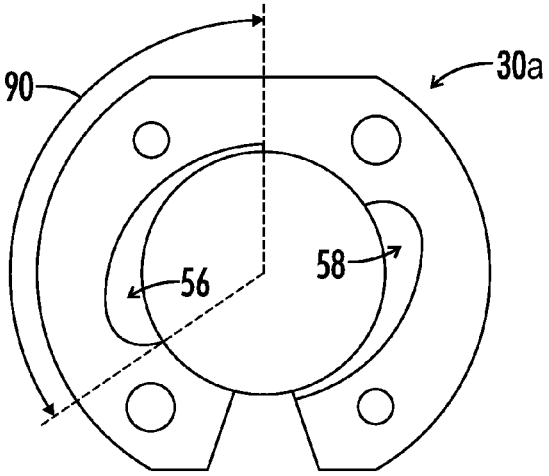
FIG. 5A illustrates a plan view of an embodiment of the first jaw housing member of FIG. 3B.
Figure 5B:
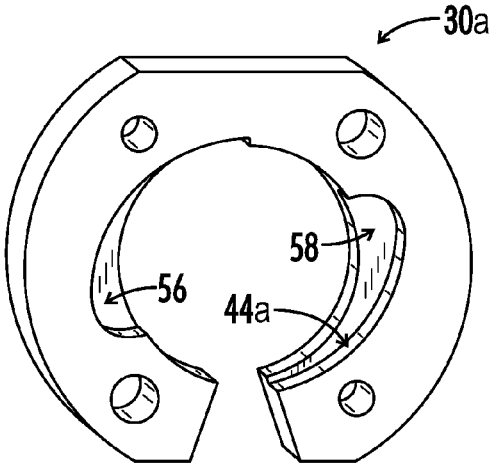
FIG. 5B illustrates a perspective view of the embodiment of the first jaw housing member of FIG. 5A.

As seen in FIGS. 5A and 5B, first and second cams 52, 62 are shaped to fit in corresponding first and second cam recesses 56, 58 defined in the jaw housing. Referring again to FIG. 4A, first cam 52 includes a first cam angle 80 defined as the circumferential distance occupied by first cam 52. First cam angle 80 in some embodiments is between about sixty and about one-hundred-and-twenty degrees. As seen in FIG. 5A, first cam recess 56 defines a first recess angle 90. First recess angle 90 in some embodiments is greater than first cam angle 80, and the profile of first cam recess 56 is larger than the profile of first cam 52. Because first recess angle 90 is greater than first cam angle 80, first jaw member 50 can translate relative to first housing member 30*a* when first housing member 30*a* is rotated.

Referring again to FIG. 4B, in one embodiment, first cam 50 includes a first cam axial length 58 less than first jaw member axial length 78. As such, first cam 52 extends only partially along the length of first jaw member 50. In this embodiment, first jaw member axial length 78 is greater than jaw housing axial length 34, seen in FIG. 3A, such that part of first jaw member 50 extends axially from jaw housing 30.

Figure 6:
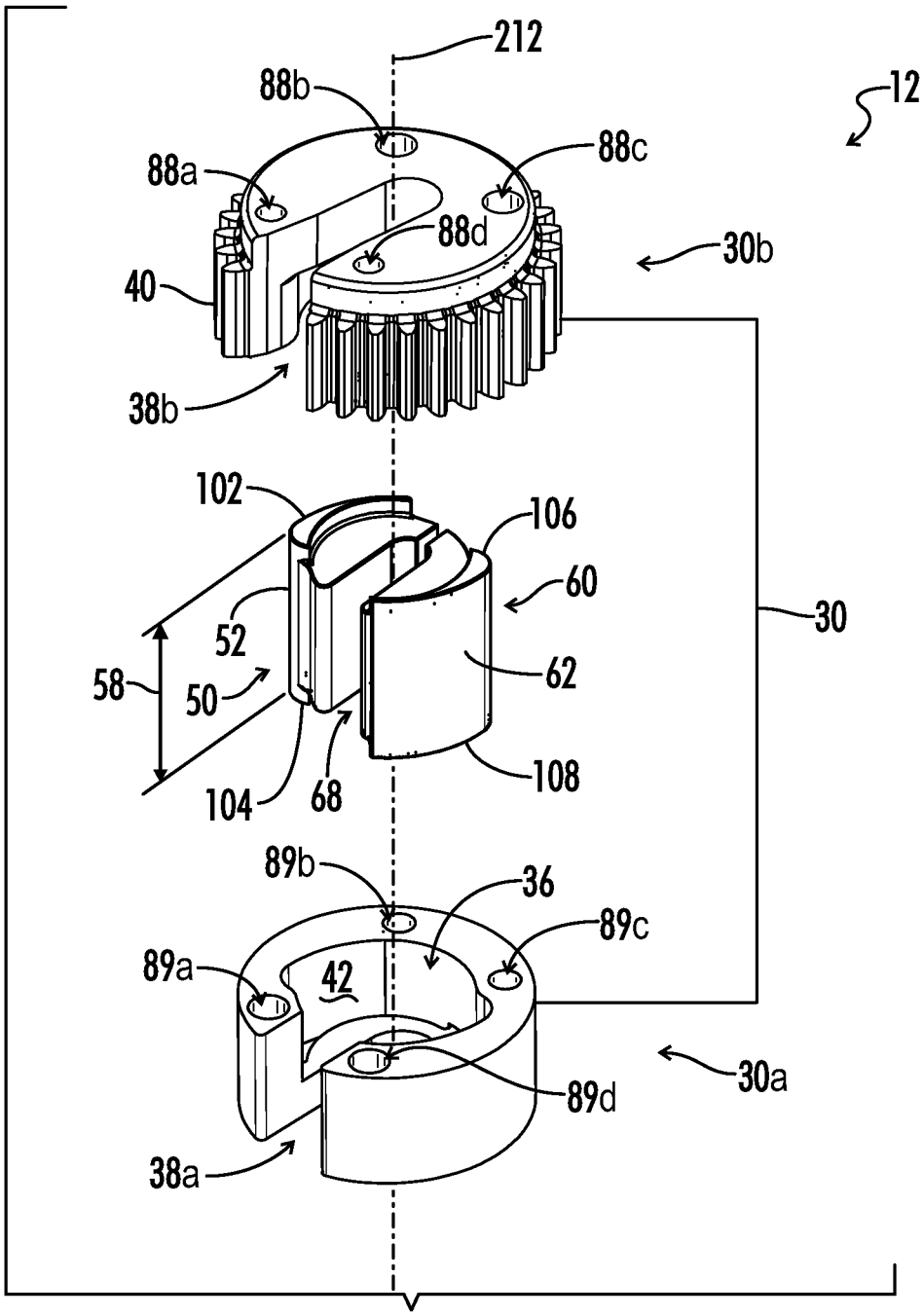
FIG. 6 illustrates an exploded perspective view of an embodiment of a jaw assembly in accordance with the present disclosure.
Figure 17:
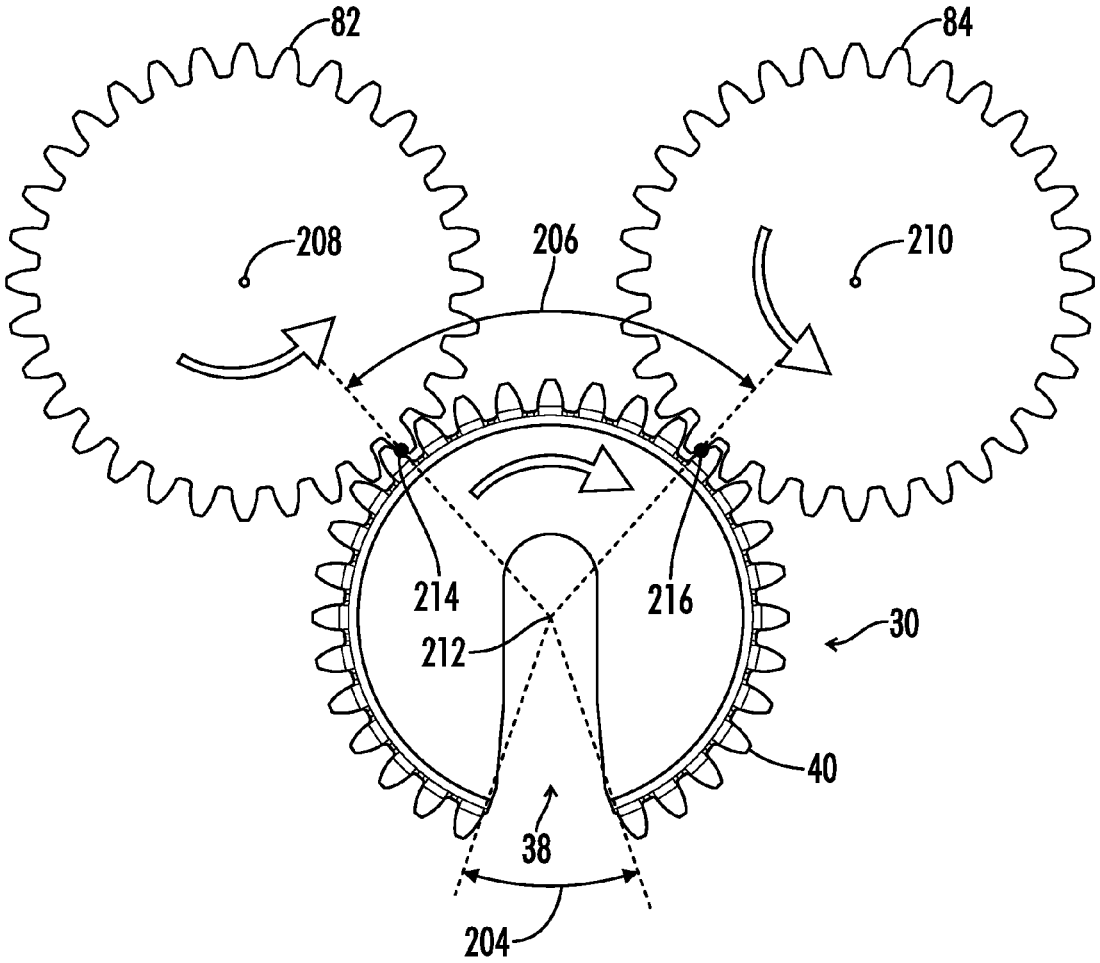
FIG. 17 illustrates a partial cross-sectional view of an embodiment of a jaw housing engaging first and second drive gears in accordance with the present disclosure.

Referring now to FIG. 6, yet another embodiment of a jaw assembly 12 provides a jaw housing 30 having a first, or lower, jaw housing member 30*a*, and a second, or upper, jaw housing member 30*b*. First and second jaw housing members 30*a*, 30*b* are axially aligned along a jaw housing axis of rotation 212 and can be attached together by one or more jaw housing fasteners or pilot rods inserted through clearance holes 88*a*, 88*b*, 88*c*, 88*d* defined in second jaw housing member 30*b* and engaging fastener holes 89*a*, 89*b*, 89*c*, 89*d* defined in first jaw housing member 30*a*. In one embodiment, one or more fastener holes 89*a*, 89*b*, 89*c*, 89*d* on first jaw housing member 30*a* are threaded for threadedly engaging a jaw housing fastener. An interior cavity 36 is defined between first and second jaw housing members 30*a*, 30*b*. As seen in one embodiment in FIG. 6, second jaw housing member 30*b* can include a circumferential housing gear 40 disposed thereon. In other embodiments, circumferential housing gear 40 is disposed on first jaw housing member 30*a*. In yet other embodiments, circumferential housing gear 40 can be disposed on both first and second jaw housing members 30*a*, 30*b*. Circumferential housing gear 40 generally engages one or more drive gears, as illustrated in FIG. 17.

It is understood that, in some embodiments second jaw housing member 30*b* can be removed from first jaw housing member 30*a*, allowing removal or insertion of first and/or second jaw members 50, 60. In some embodiments, one or both jaw members 50, 60 can be replaced for use with different wire dimensions or with different materials. For example, when one or more wires of a relatively small diameter are to be twisted, it may be desirable to insert first and/or second jaw members 50, 60 such that a correspondingly narrow jaw gap 68 is defined therebetween. In contrast, when one or more wires of a larger diameter are to be twisted, it may be desirable to replace the first and/or second jaw members 50, 60 with a different set of jaw members defining a larger jaw gap 68 for accommodating the larger diameter wires. Additionally, during use, one or both jaw members 50, 60 can become worn or damaged and may need to be replaced. The present disclosure provides a jaw assembly 12 allowing first and second jaw housing members 30*a*, 30*b* to be separated for replacement of first and/or second jaw members 50, 60. Further, it may be desirable to use first and second jaw members 50, 60 having specific material properties in a first application, and it may be subsequently desirable to use a second set of jaw members with differing material properties in a second application. For example, in a first application for twisting wire of a first hardness, it may be necessary to have jaw members with a relatively high material hardness; however, a subsequent application for twisting wire strands of a lower hardness may require use of separate jaw members having a lower material hardness to prevent damaging or breaking the wire strands. The present disclosure provides a modular jaw assembly 12 allowing jaw member replacement facilitating use of one jaw member housing 30 with various jaw member configurations for different applications.

Figure 7A:
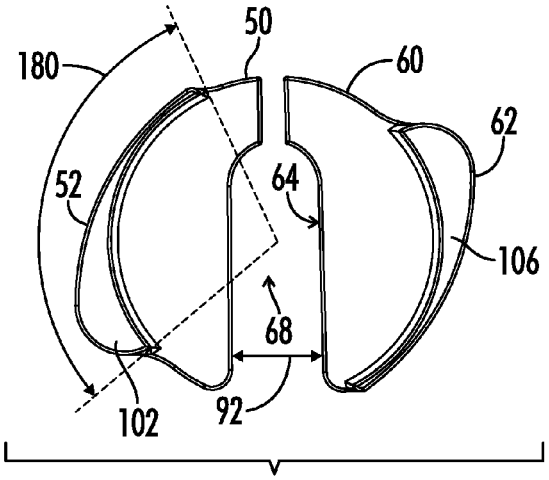
FIG. 7A illustrates a plan view of an embodiment of the first and second jaw members of FIG. 6.
Figure 7B:
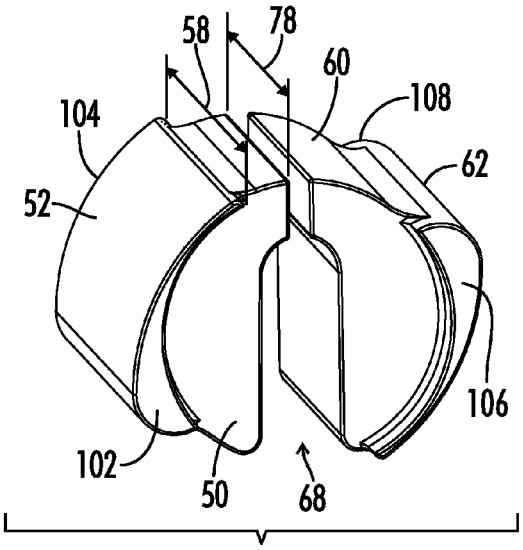
FIG. 7B illustrates a perspective view of an embodiment of the first and second jaw members of FIG. 7A.

Referring further to FIG. 6, in yet another embodiment, first jaw member 50 includes first cam 52 having a first cam lobe 102 protruding axially therefrom generally toward second jaw housing member 30*b*. A second cam lobe 104 can also protrude axially from first jaw member 50 toward first jaw housing member 30*a*. Also seen in FIG. 7B, third and fourth cam lobes 106, 108 protrude from second jaw member 60. Each first and second cam lobe 102, 104 include the cross-sectional profile of first cam 52, and each third and fourth cam lobe 106, 108 includes the cross-sectional profile of second cam 62. As seen in FIG. 7B, first cam 52 defines an axial cam length 58 greater than axial first jaw member length 78 in some embodiments.

Figure 8A:
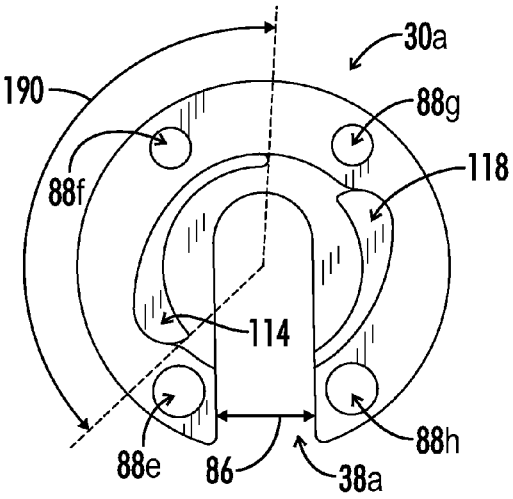
FIG. 8A illustrates a plan view of an embodiment of the first jaw housing member of FIG. 6.
Figure 8B:
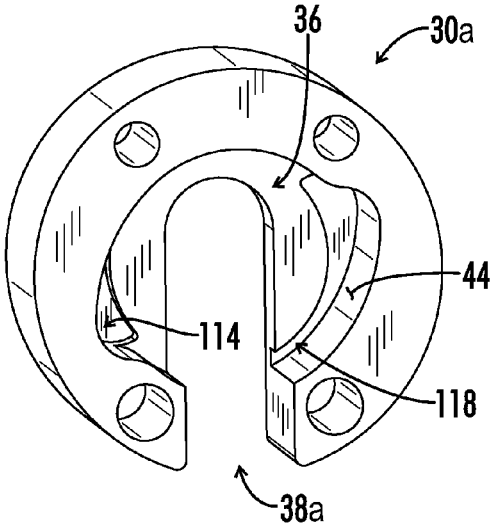
FIG. 8B illustrates a perspective view of an embodiment of the first jaw housing member of FIG. 8A.
Figure 9:
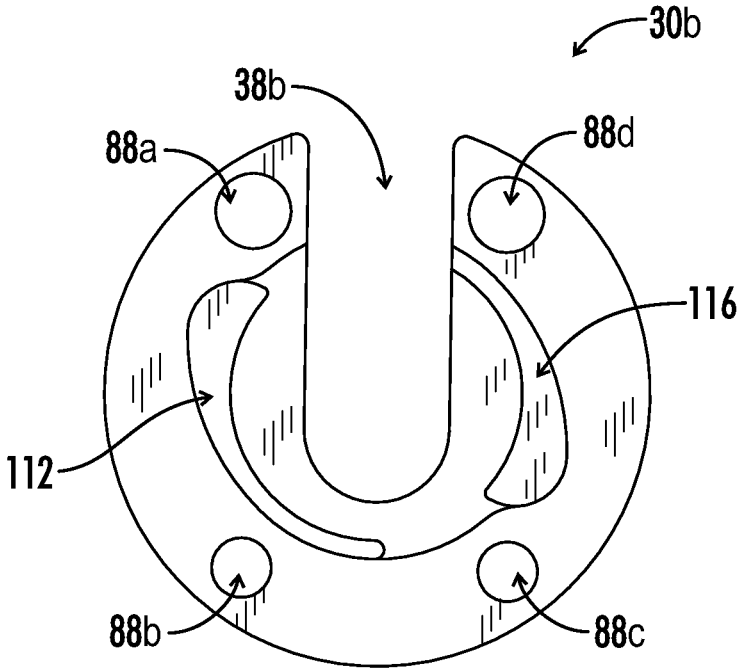
FIG. 9 illustrates a plan view of an embodiment of the second jaw housing member of FIG. 6.

In some embodiments, each first and second cam lobe 102, 104 engages a corresponding groove, or cam groove, defined in first and second jaw housing members 30*a*, 30*b*, respectively. Referring now to FIG. 6 and FIG. 9, first cam lobe 102 generally engages a first cam groove 112 defined in second jaw housing member 30*b*. Similarly, third cam lobe 106 generally engages third cam groove 116 defined in second jaw housing member 30*b*. Referring now to FIG. 6 and FIG. 8A, second cam lobe 104 generally engages second cam groove 114, and fourth cam lobe 108 generally engages fourth cam groove 118. Each cam lobe 102, 104, 106, 108 has a smaller cross-sectional profile than its corresponding cam groove 112, 114, 116, 118. As such, each cam lobe can translate angularly and/or radially relative to each jaw housing member as jaw housing 30 is rotated relative to first and second jaw members 50, 60.

Referring now to FIG. 7B and FIG. 8A, each cam lobe 102, 104, 106, 108 in some embodiments defines a cam lobe angle less than a corresponding cam groove angle defined in the first or second jaw housing member 30*a*, 30*b*. For example, first cam lobe 102, seen in FIG. 7A, defines a first cam lobe angle 180 defined as the angular distance occupied by first cam lobe. Second cam lobe 104 is an extension of first cam 52 and also defines the same first cam lobe angle 180. Second cam groove 114 defines a second groove angle 190 defined as the angular distance occupied by second cam groove 114, seen in FIG. 8A. Second groove angle 190 is greater than first cam lobe angle 180. As such, when first jaw housing member 30*a* is rotated counter-clockwise relative to first jaw member 50, second cam lobe 104 can translate inside second cam lobe groove 114, allowing first cam 52 to slidably engage first cam surface 42 and move radially inwardly, thereby providing a clamping force on one or more wires positioned in jaw gap 68. Second jaw member can move in a similar fashion when the jaw housing is rotated.

Figure 10:
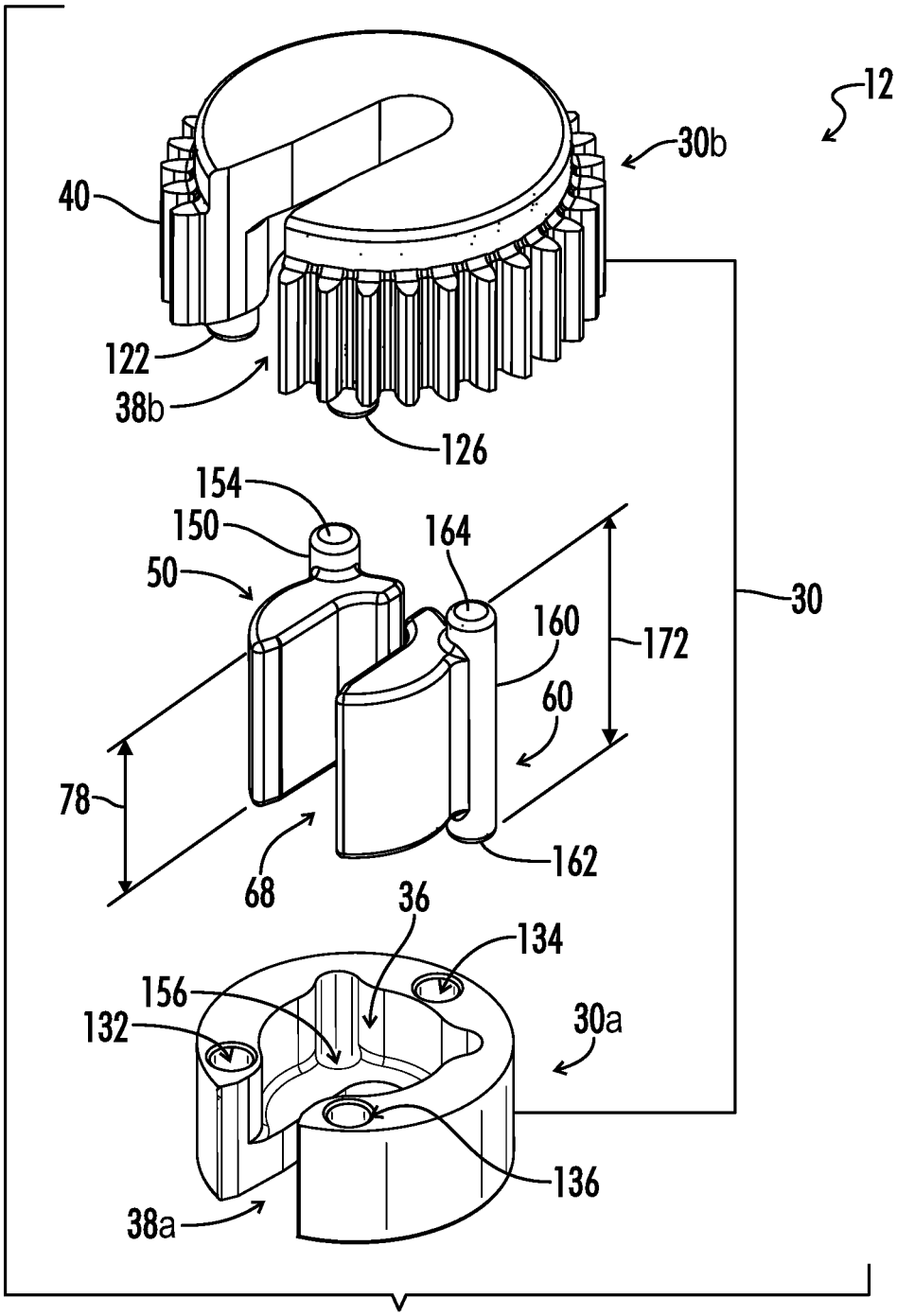
FIG. 10 illustrates an exploded perspective view of an embodiment of a jaw assembly in accordance with the present disclosure.
Figure 13A:
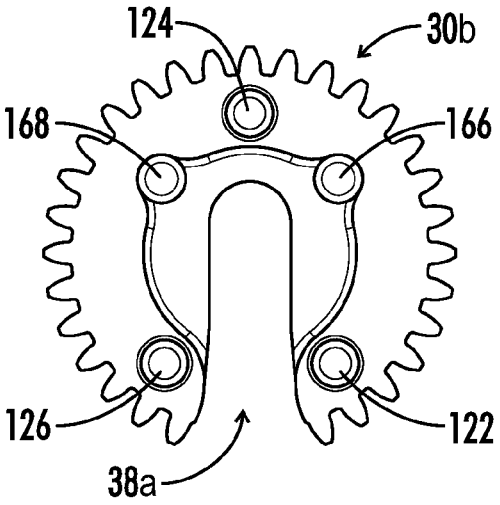
FIG. 13A illustrates a bottom plan view of an embodiment of the second jaw housing member of FIG. 10.
Figure 13B:
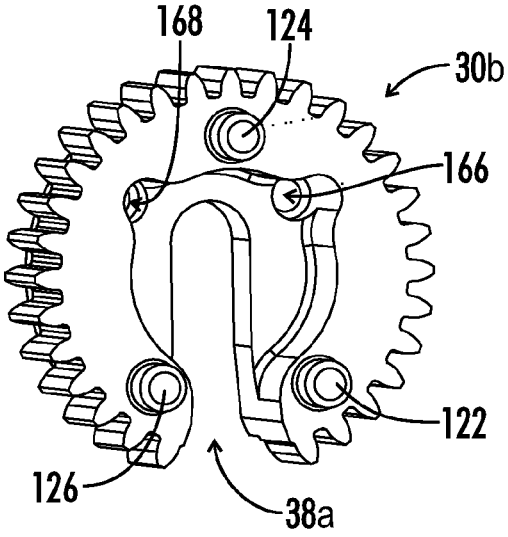
FIG. 13B illustrates a bottom perspective view of an embodiment of the second jaw housing member of FIG. 10.

Referring now to FIG. 10, an exploded view of yet another embodiment of a jaw assembly 12 in accordance with the present disclosure is generally illustrated. Jaw assembly 12 includes a jaw housing 30 having a first, or lower, jaw housing member 30*a*. Jaw housing 30 also includes a second, or upper, jaw housing member 30*b*. In some embodiments, first and second jaw housing members 30*a*, 30*b* can be attached together using mechanical fasteners, not shown. It is understood that, in some other embodiments, first and second jaw housing members 30*a*, 30*b* include one or more posts and corresponding sockets defined in each jaw housing member for attaching the jaw housing members together. Referring to FIG. 10 and FIGS. 13A and 13B, second jaw housing member 30*b*, in some embodiments, includes a plurality of posts 122, 124, 126 protruding from second jaw housing member 30*b* generally toward first jaw housing member 30*a*. Each post 122, 124, 126 engages a corresponding socket 132, 134, 136 defined in first jaw housing member 30*a*, seen in FIG. 10. In some embodiments, each post engages each socket and provides a proper angular alignment between first and second jaw housing members 30*a*, 30*b*, and also ensures that first housing slot 38*a* is angularly aligned with second housing slot 38*b* when second jaw housing member 30*b* is installed on first jaw housing member 30*a*. It will be readily appreciated by those of skill in the art that the post and socket configuration illustrated in FIG. 10 and the jaw fastener configurations illustrated in FIG. 3B and FIG. 6 can be used interchangeably or in combination in other embodiments for securing first and second jaw housing members 30*a*, 30*b* together.

Figure 12A:
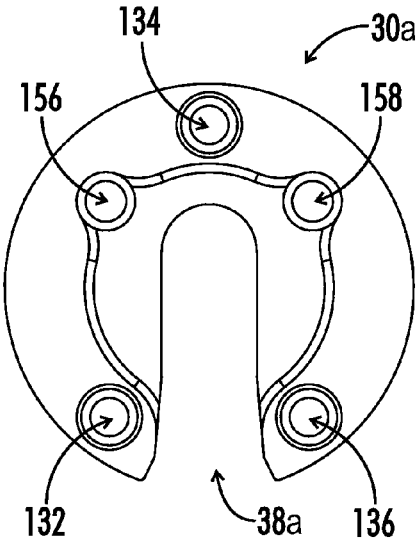
FIG. 12A illustrates a plan view of an embodiment of the first jaw housing member of FIG. 10.
Figure 12B:
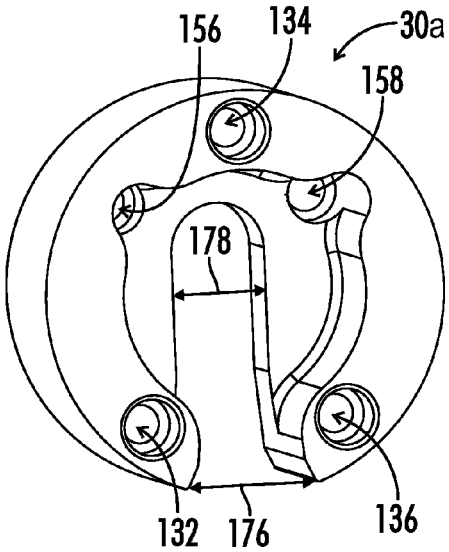
FIG. 12B illustrates a perspective view of an embodiment of the first jaw housing member of FIG. 10.

Referring again to FIG. 10, in some embodiments, a first jaw member 50 is disposed in jaw housing 30 and includes a first jaw axle 150 extending from first jaw member 50. First jaw axle 150 generally engages first axle socket 156. As such, first jaw member 50 is pivotable about first jaw axle 150 inside jaw housing 30. Similarly, second jaw member 60, disposed in jaw housing 30, includes a second jaw axle 160 extending from second jaw member 60. Second jaw axle 160 pivotally engages second axle socket 158, seen in FIGS. 12A and 12B. As such, second jaw member 60 is pivotable about second jaw axle 160 inside jaw housing 30. Each jaw member axial length 78 is generally less than each axial axle length 172, as seen in FIG. 10.

Figure 14:
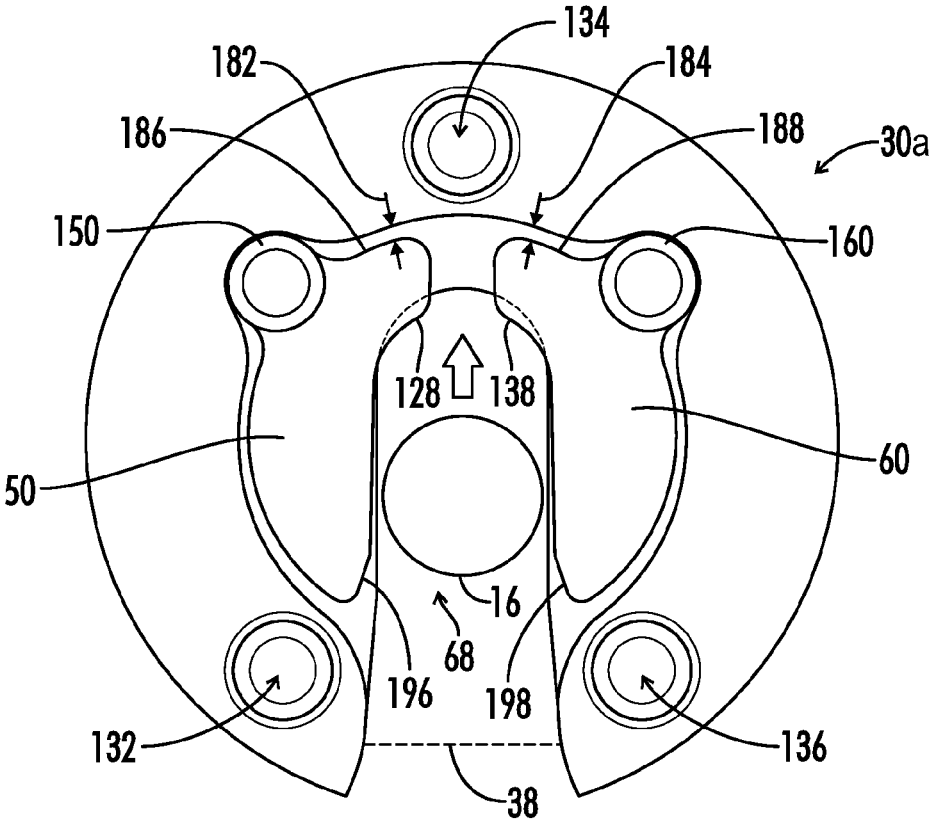
FIG. 14 illustrates a partial cross-sectional view of an embodiment of a jaw assembly having a wire partially inserted in the jaw gap.

During use, each first and second jaw member 50, 60 can pivot about its respective jaw axle to engage one or more wires positioned in jaw gap 68. Referring now to FIG. 14, in one embodiment, first jaw member 50 can pivot about first jaw axle 150, wherein first jaw axle 150 serves as a fulcrum for first jaw member 50. First jaw member 50 includes a first effort arm 186 extending toward second jaw member 60 and a first resistance arm 196 extending away from first jaw axle 150. Similarly, second jaw member 60 can pivot about second jaw axle 160, wherein second jaw axle 160 serves as a fulcrum for second jaw member 60. Second jaw member 60 includes a second effort arm 188 extending toward first jaw member 50 and a second resistance arm 198 extending away from second jaw axle 160.

First jaw member 50 defines a first pivot gap 182 between first effort arm 186 and first housing member 30*a*. First pivot gap 182 provides clearance for first jaw member 50 to pivot about first jaw axle 150. Similarly, second jaw member 60 defines a second pivot gap 184 between second effort arm 188 and first housing member 30*a*. Second pivot gap 184 provides clearance for second jaw member 60 to pivot about second jaw axle 160. Also, first jaw member 50 includes a first inner edge 128, and second jaw member includes a second inner edge 138. Each inner edge 128, 138 faces jaw gap 68. In some embodiments, a first compression spring can be disposed in first pivot gap 182 for biasing first inner edge 128 away from the jaw housing wall, and a second compression spring can be disposed in second pivot gap 184 for biasing the second inner edge 138 away from the jaw housing wall.

Figure 11A:
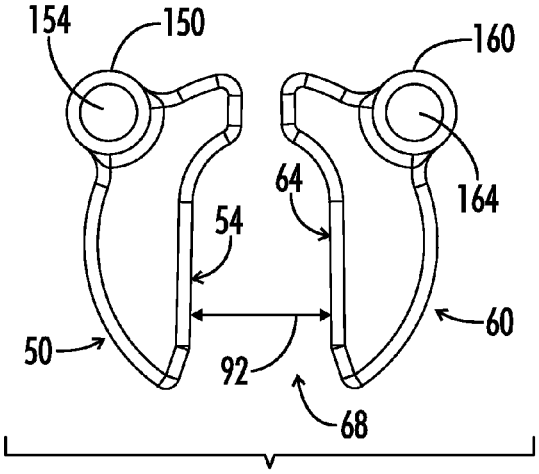
FIG. 11A illustrates a plan view of an embodiment of the first and second jaw members of FIG. 10.
Figure 11B:
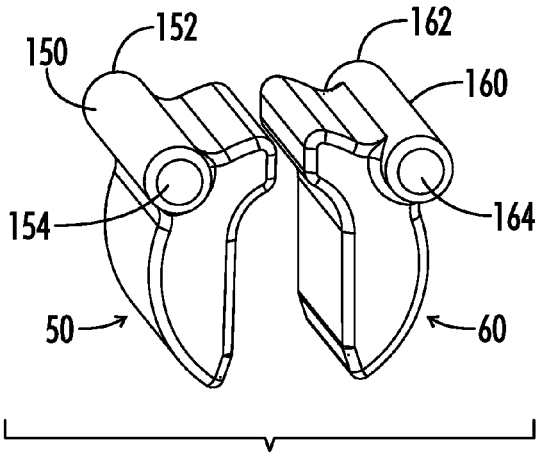
FIG. 11B illustrates a perspective view of the first and second jaw members of FIG. 10.
Figure 15:
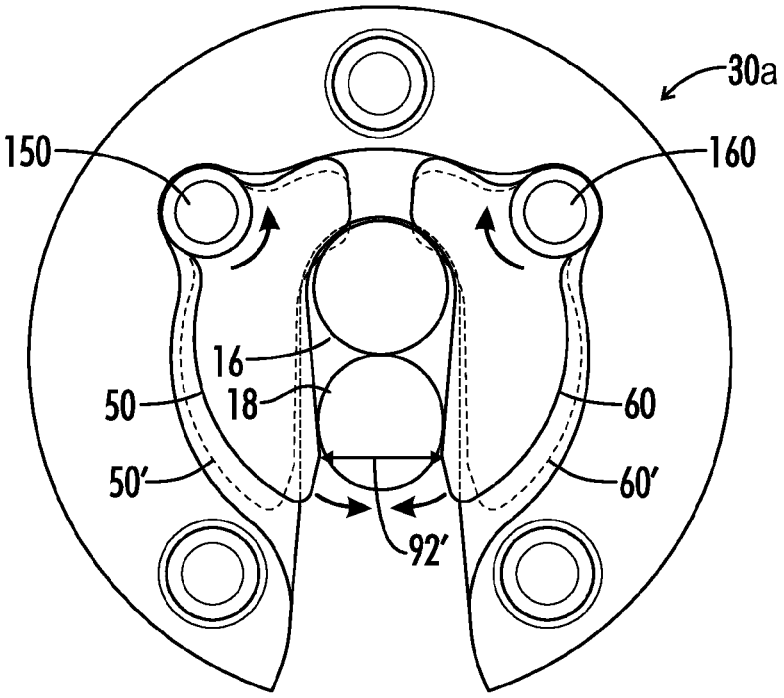
FIG. 15 illustrates a partial cross-sectional view of an embodiment of a jaw assembly having multiple wires inserted in the jaw gap.

As illustrated in FIG. 14, a wire strand 16 can be inserted into jaw gap 68 between first and second jaw members 50, 60. Upon insertion, wire strand 16 can engage first and second inner edges 128, 138, causing first jaw member 50 to pivot about first jaw member axle 150 and causing second jaw member 60 to pivot about second jaw member axle 160, as illustrated in FIG. 15. As first and second jaw members pivot, first and second resistance arms 196, 198 move inwardly, generally toward each other, applying a clamping force to one or more wire strands positioned in jaw gap 68. As seen in FIG. 15, following the pivoting of first and second jaw members 50, 60, a new jaw gap distance 92' is defined between first and second jaw members. The new jaw gap distance 92' is generally less than original jaw gap distance 92, seen in FIG. 11A. From this position, the jaw housing can be subsequently rotated to twist the wire strands 16, 18 together.

Figure 16:
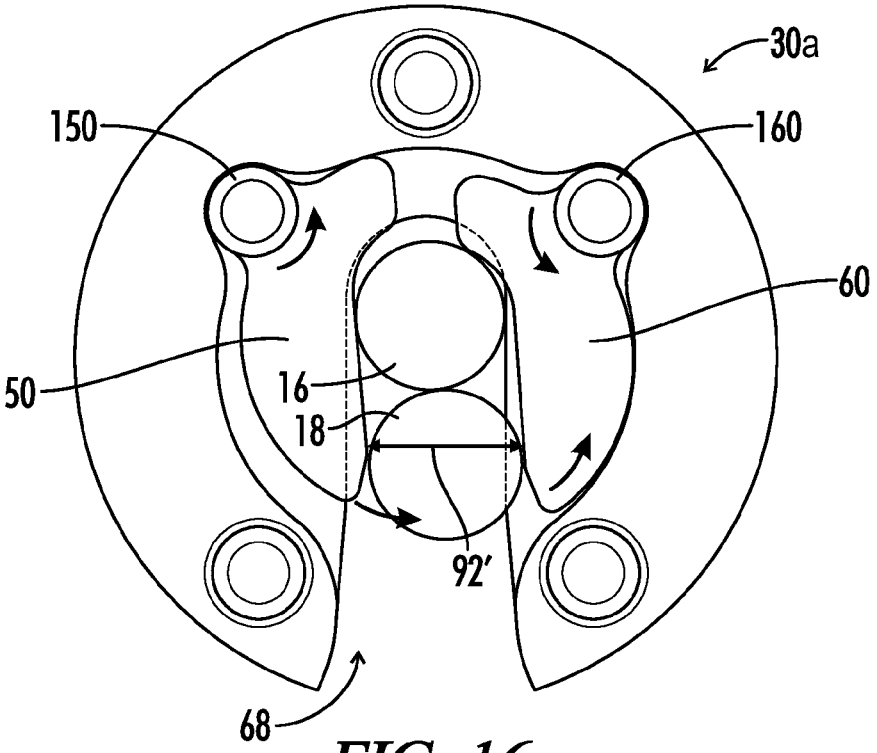
FIG. 16 illustrates a partial cross-sectional view of one embodiment of a jaw assembly showing pivoting jaw members.

It is further appreciated that, in some embodiments, a second mode of clamping force is provided against one or more wires in jaw gap 68 by first and second jaw members 50, 60. The second mode of clamping force is not provided by engagement of first and second inner edges 128, 138 by the wire strands being inserted into jaw gap 68, but rather is provided by reorientation of first and second jaw members about each respective jaw axle when the jaw housing is rotated. In some embodiments, each wire strand includes a free end inserted into the jaw gap 68 and an opposite end fixed to a wire mesh panel. When two or more wires are inserted into jaw gap 68 in the embodiment illustrated in FIG. 16, the jaw housing may be subsequently rotated relative to the first and second wire strands 16, 18. The wire strands 16, 18 have a tendency to remain oriented in the initial angular alignment, causing the first and second jaw members to each rotate about its jaw axle. First jaw member 50 rotates generally toward jaw gap 68, and second jaw member 60 rotates generally away from jaw gap 68 when jaw housing member 30*a* is rotated clockwise, as seen in FIG. 16. The rotated jaw members define a new jaw gap distance 92' that is narrower than the original jaw gap distance 92. As a result, a clamping force can be applied to first and second wire strands 16, 18 by first and second jaw members. As the jaw housing is rotated further, first and second jaw members and first and second wire strands rotate simultaneously with the jaw housing, twisting the wire strands around each other.

After twisting, the jaw assembly generally can be disengaged from the wire in at least two ways. First, the jaw assembly can be rotated unidirectionally one or more full rotations such that housing slot 38 is aligned with mouth 22 after the one or more full rotations, as seen in FIG. 2, thereby allowing the wire to be extracted from the mouth 22 of wire twister 10. Alternatively, the housing may be initially rotated only a fraction of a full rotation, or one or more full rotations plus a partial rotation, and then subsequently rotated the same angular distance in the opposite angular direction until the housing slot 38 is angularly aligned with mouth 22. Using this second sequence, the first and second jaw members will generally release their clamp on the wire when the direction of angular rotation is reversed, allowing the wire to be extracted from jaw gap 68 and through mouth 22.

Figure 20:
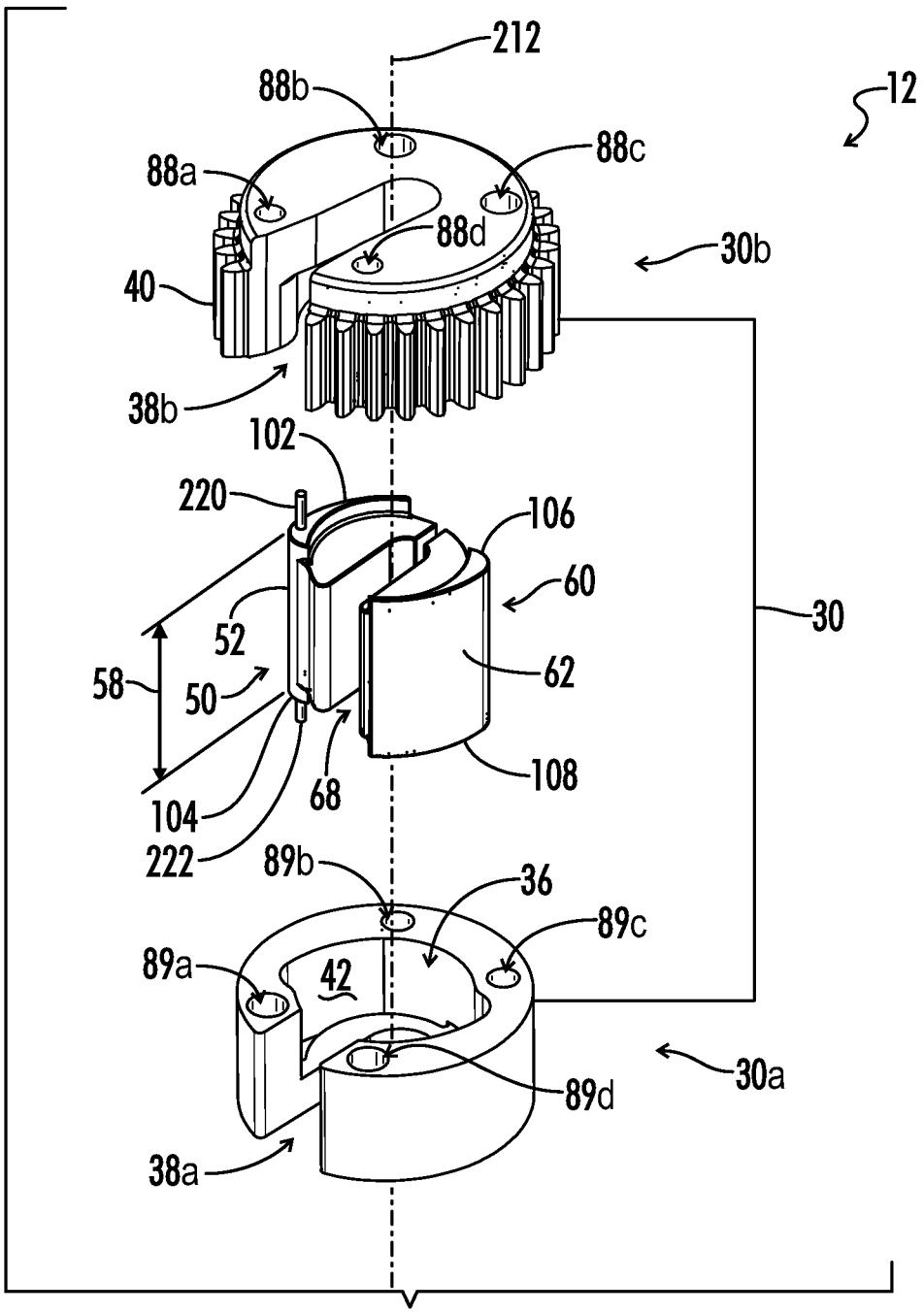
FIG. 20 illustrates an exploded perspective view of an additional embodiment of a jaw assembly.
Figure 21:
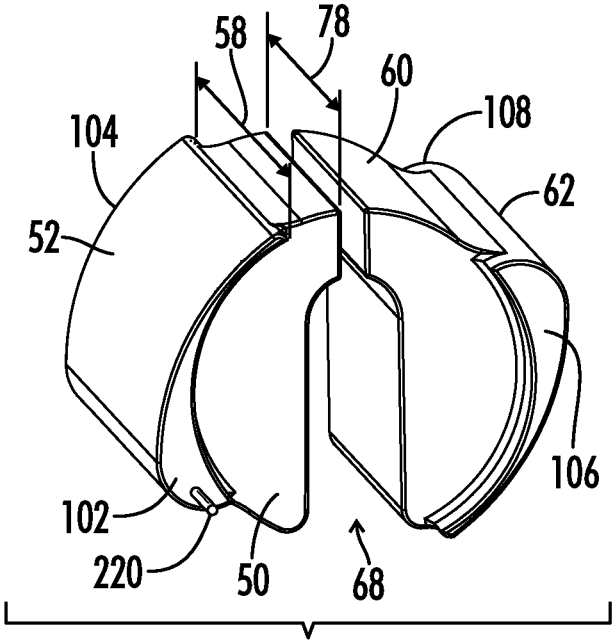
FIG. 21 illustrates a perspective view of an additional embodiment of first and second jaw members including a retainer post extending from the first jaw member.
Figure 22:
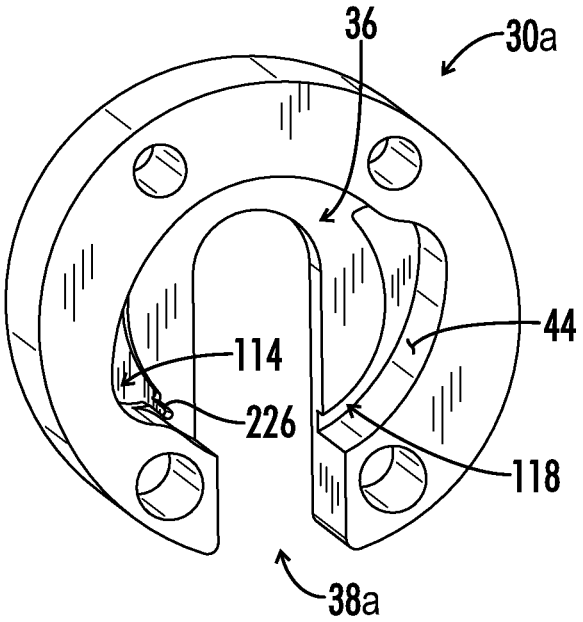
FIG. 22 illustrates a perspective view of an embodiment of a first jaw housing member including a retainer slot shaped for receiving a retainer post.

After the jaw assembly has been removed from one or more twisted wire strands, it may be desirable to subsequently receive another region of wire in the jaw gap and perform an additional twisting operation. In some applications, the first jaw member 50 can have a tendency to extend into jaw gap following a wire twisting procedure, or before a wire twisting procedure, thereby partially blocking the jaw gap. Such blockage of jaw gap 68 by one of the jaw members can make it difficult to subsequently receive another wire region into the jaw gap 68 for a subsequent twisting operation. Referring now to FIGS. 20 and 21, in some applications one or more retainer posts 220, 222 can extend from a jaw member. Each retainer post is operable to prevent the jaw member from inadvertently sliding into and blocking jaw gap 68. For example, in some embodiments, a first retainer post 220 extends from first cam lobe 102, and a second retainer post 222 extends from second cam lobe 104. Each retainer post can engage a corresponding retainer slot defined in a jaw housing member. For example, first retainer post 220 engages a first retainer slot (not shown) defined in second jaw housing member 30*b* and second retainer post 222 engages a second retainer slot 226 defined in first jaw housing member 30*a*, seen in FIG. 22. Second retainer slot 226 is defined in first jaw housing member 30*a* adjacent second cam groove 114. Second retainer slot 226 can include a depth greater than the depth of second cam groove 114 for accommodating second retainer post 222 in some embodiments. Similarly, first retainer slot (not shown) can include a depth greater than the depth of the first cam groove for accommodating first retainer post 220 in some embodiments. During use, second retainer post 222 slidably engages second retainer slot 226 and is operable to prevent first jaw member 50 from advancing too far into jaw gap 38 and blocking ingress of a wire strand. First retainer slot (not shown) has a similar position adjacent the first cam groove formed in second jaw housing member 30*b*. In further embodiments, first and/or second retainer posts 220, 222 can be disposed directly on first jaw member 50. Similar structures can be positioned on second jaw member 60 in some embodiments.

Figure 23:
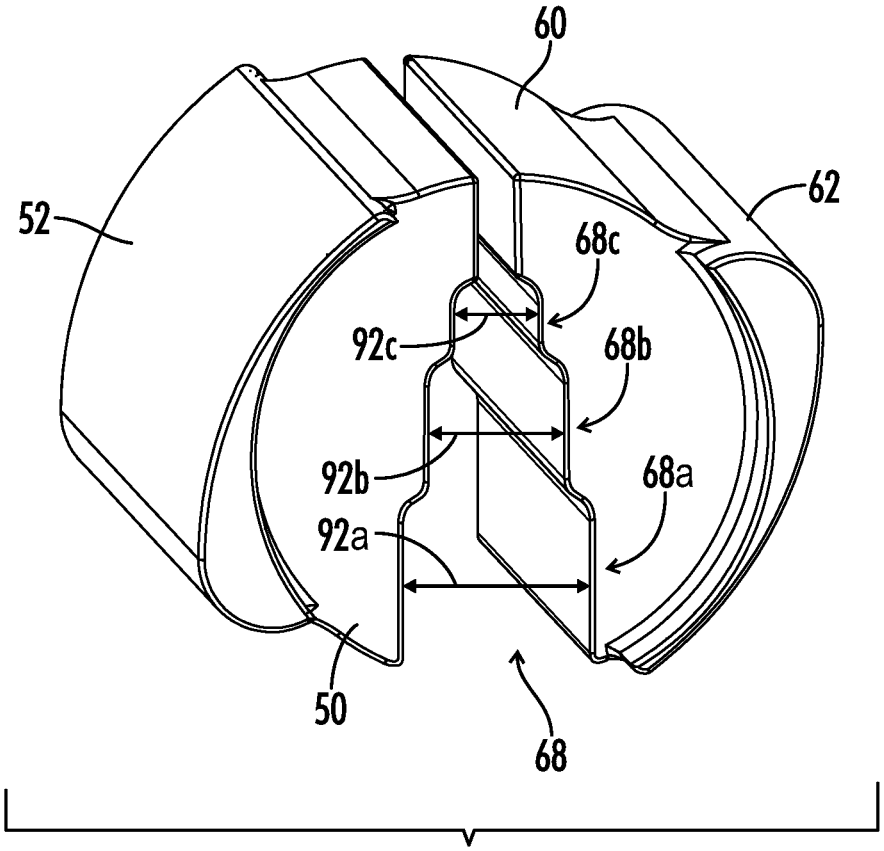
FIG. 23 illustrates an embodiment of first and second jaw members having stepped wire engagement surfaces.

Referring now to FIG. 23, in some embodiments, first and second jaw members 50, 60 may be configured to include a jaw gap 68 having varying jaw gap dimensions. Such embodiments may include one or both jaw members having a stepped wire engagement surface. For example, a first jaw gap section 68*a* includes a first jaw gap width 92*a*. A second jaw gap section 68*b* is located interior first jaw gap section 68*a* and includes a second jaw gap width 92*b* less than the first jaw gap width 92*a*. A third jaw gap section 68*c* is located interior second jaw gap section 68*b* and includes a third jaw gap width 92*c* less than first and second jaw gap widths 92*a* and 92*b*. In some embodiments, first and second jaw members 50, 60 including varying jaw gap dimensions may be used to accommodate wires having different diameters. For example, a first wire having a first diameter slightly less than second jaw gap width 92*b* may be positioned in second jaw gap section 62*b*, and a second wire having a second wire diameter greater than second jaw gap width 92*b* can be positioned in first jaw gap section 62*a*. Thus, one set of jaws 50, 60 can be used to accommodate wires having different diameters without changing the jaws from the jaw housing. In additional applications, one set of jaws 50, 60 can be used to twist together a first group of two or more wires having a first diameter and then subsequently to twist together a second group of two or more wires having a second diameter, wherein the second diameter is not equal to the first diameter. In some embodiments, only one jaw member includes a stepped wire engagement surface.

In additional embodiments, the present disclosure provides a method of twisting wires. The method includes the steps of: (a) providing a wire twisting apparatus including a jaw housing and first and second jaw members disposed in the jaw housing, the jaw housing including a housing slot shaped for receiving the wires; (b) positioning the wires in the housing slot of the jaw housing between the first and second jaw members; and (c) rotating the jaw housing relative to at least one of the first and second jaw members so that at least one of the first and second jaw members moves toward the other jaw member and engages the wires.

The method may further include the step of twisting the wires together by simultaneously rotating the jaw housing and the first and second jaw members. In additional embodiments wherein the first jaw member includes a cam extending outwardly therefrom, the method may further include engaging the jaw housing with the cam to move the first jaw member toward the second jaw member when the jaw housing is rotated. In addition embodiments, wherein the jaw housing includes an axial socket and the first jaw member includes a jaw axle extending axially therefrom pivotally engaging the axial socket, the method includes rotating the jaw housing about the first jaw member so that the first jaw member rotates about the first axle and moves toward the second jaw member.

Wire twisting tools and methods described above may be used in a variety of applications. Such applications include, but are not limited to, twisting together wires of mesh panels for preparing concrete perform structures; twisting one or more fence wires together for forming a fence or for preparing fencing materials; twisting wires for wire packaging; twisting wires for electrical applications such as connecting wire cables or preparing a wire end for receiving a lug attachment; preparing lugs for attachment to grounding panels; shearing a single wire by twisting; twisting multi-stranded wire end to prevent end fraying; or any other suitable applications requiring twisting of one or more wires.

Thus, although there have been described particular embodiments of the present invention of new and useful Wire Twisting Tools and Methods, it is not intended that such references be construed as limitations upon the scope of this invention except as set forth in the following claims.

What is claimed is:

1. An apparatus for twisting wire, the apparatus comprising:

a jaw housing defining a housing slot shaped for receiving the wire;

a first jaw member disposed in the jaw housing, wherein the jaw housing is moveable relative to the first jaw member;

a second jaw member disposed in the jaw housing; and the first jaw member being movable relative to the second jaw member to clamp the wire between the first and second jaw members when the jaw housing is rotated;

wherein the jaw housing further comprises first and second jaw housing members axially aligned, the first and second jaw housing members defining an interior cavity therebetween, wherein the second jaw housing member is removable for accessing the interior cavity.

2. The apparatus of claim 1, further comprising:

a circumferential housing gear disposed on the jaw housing.

3. The apparatus of claim 2, further comprising:

a first drive gear engaging the circumferential housing gear at a first engagement location; and a second drive gear engaging the circumferential housing gear at a second engagement location, wherein the first and second engagement locations are angularly offset by a drive gear offset angle.

4. The apparatus of claim 3, further comprising:

the housing slot defining a housing slot opening angle, wherein the drive gear offset angle is greater than the housing slot opening angle.

5. The apparatus of claim 1, wherein the first jaw housing member includes a circumferential housing gear.

6. The apparatus of claim 1, wherein the second jaw housing member includes a circumferential housing gear.

7. The apparatus of claim 1, wherein the second jaw member is integrally formed on the jaw housing.

8. The apparatus of claim 1, wherein:

the jaw housing defines a first axle socket;

the first jaw member includes a first jaw axle protruding axially from the first jaw member; and the first jaw axle is pivotally disposed in the first axle socket.

9. The apparatus of claim 8, wherein the first jaw member is operable to pivot about the first jaw axle when the jaw housing is rotated relative to the first jaw member.

10. The apparatus of claim 8, wherein:

the jaw housing defines a second axle socket;

the second jaw member includes a second jaw axle protruding axially from the second jaw member; and the second jaw axle is pivotally disposed in the second axle socket.

11. An apparatus for twisting wire, the apparatus comprising:

a jaw housing defining a housing slot shaped for receiving the wire and an interior cavity;

a first jaw member disposed in the interior cavity of the jaw housing, wherein the jaw housing is moveable relative to the first jaw member;

a second jaw member disposed in the interior cavity of the jaw housing; and the first jaw member being movable relative to the second jaw member to clamp the wire between the first and second jaw members when the jaw housing is rotated;

the first jaw member including a first cam extending outwardly therefrom; and the jaw housing defining a first cam surface positioned for engaging the first cam.

12. The apparatus of claim 11 wherein the first cam is operative to engage the first cam surface and to push the first jaw member toward the second jaw member when the jaw housing is rotated relative to the first jaw member.

13. The apparatus of claim 11, wherein the first jaw member defines a first wire engagement surface facing the housing slot.

14. The apparatus of claim 11, further comprising a circumferential housing gear disposed on the jaw housing.

15. The apparatus of claim 11, wherein the jaw housing further comprises:

a first jaw housing member; and a second jaw housing member, wherein the first jaw housing member is removable for accessing the interior cavity.

16. The apparatus of claim 11, wherein:

the jaw housing defines a second cam surface facing the interior cavity;

the second jaw member includes a second cam extending outwardly therefrom; and the second cam being operable to slidably engage the second cam surface when the jaw housing is rotated relative to the first and second jaw members.

17. The apparatus of claim 16, wherein:

the first jaw member defines a first wire engagement surface facing the housing slot;

the second jaw member defines a second wire engagement surface facing the first wire engagement surface; and a jaw gap defined between the first and second jaw members.

18. An apparatus for twisting one or more strands of wire, the apparatus comprising:

a jaw housing defining a first axle socket; and a first jaw member disposed in the jaw housing, the first jaw member including a first jaw axle extending axially from the first jaw member, the first jaw axle pivotally engaging the first axle socket, wherein the first jaw member is pivotable about the first jaw axle inside the jaw housing.

19. The apparatus of claim 18, further comprising:

the jaw housing defining a second axle socket; and a second jaw member disposed in the jaw housing, the second jaw member including a second jaw axle extending axially from the second jaw member and pivotally engaging the second axle socket, wherein the second jaw member is pivotable inside the jaw housing about the second jaw axle.

20. The apparatus of claim 18, wherein the jaw housing further comprises:

a first jaw housing member;

a second jaw housing member axially aligned with the first jaw housing member; and a circumferential housing gear disposed on at least one of the first and second jaw housing members.

21. An apparatus for twisting wire, comprising:

a rotatable jaw housing;

a circumferential housing gear disposed on an external circumferential surface of the jaw housing; and a jaw member disposed in the jaw housing, wherein the jaw member is movable relative to the jaw housing to clamp the wire when the jaw housing rotates.

22. The apparatus of claim 21, further comprising:

a housing slot defined in the jaw housing shaped for receiving the wire.

23. The apparatus of claim 21, further comprising:

a stepped wire engagement surface disposed on the jaw member.

24. An apparatus for twisting wire, comprising:

a tool body;

a jaw housing attached to the tool body, the jaw housing including a housing slot shaped for receiving the wire, wherein the jaw housing is rotatable relative to the tool body; and a jaw member disposed in the jaw housing, the jaw member including a cam extending outwardly therefrom and being movable relative to the jaw housing, the jaw housing defining a first cam surface positioned for engaging the first cam, wherein the jaw member is configured to advance toward the housing slot when the jaw housing is rotated.

* * * * *